US009291326B2

(12) United States Patent
Kosugi et al.

(10) Patent No.: US 9,291,326 B2
(45) Date of Patent: Mar. 22, 2016

(54) VEHICLE LIGHTING DEVICE

(71) Applicant: Toshiba Lighting & Technology Corporation, Yokosuka-shi, Kanagawa-ken (JP)

(72) Inventors: Daisuke Kosugi, Yokosuka (JP); Ryuji Tsuchiya, Yokosuka (JP); Toshihiro Hatanaka, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 14/169,323

(22) Filed: Jan. 31, 2014

(65) Prior Publication Data

US 2014/0334172 A1 Nov. 13, 2014

(30) Foreign Application Priority Data

May 9, 2013 (JP) ..... 2013-099656
May 30, 2013 (JP) ..... 2013-114683

(51) Int. Cl.
*F21S 8/10* (2006.01)

(52) U.S. Cl.
CPC ..... *F21S 48/328* (2013.01); *F21S 48/1154* (2013.01); *F21S 48/1241* (2013.01); (Continued)

(58) Field of Classification Search
CPC ..... B60Q 3/044; B60Q 1/28; F21K 9/00; F21K 9/52; F21K 9/54; F21K 9/1355; F21V 3/00; F21V 7/0008; F21V 7/0066; F21V 7/0091; F21V 7/04; F21V 7/09; F21V 7/91; G02B 6/0035; G02B 6/0073; G02B 6/24; F21S 2/00; F21S 11/00; F21S 48/1154; F21S 48/24; F21S 48/1241; F21S 48/215; F21S 48/2225; F21S 48/2287; F21S 48/2237; F21S 48/2243; F21S 48/225; F21S 48/2262; F21S 48/2281
USPC ..... 362/23.16, 23.17, 23.19, 23.2, 235, 362/241, 249.01, 249.02, 296.01, 311.01, 362/311.02, 326–328, 341, 347, 350, 475, 362/555, 507, 508–511, 538–540, 543–545
See application file for complete search history.

(56) References Cited

U.S. PATENT DOCUMENTS 6,350,041 B1 2/2002 Tarsa et al.
7,001,054 B2 * 2/2006 Koizumi et al. ..... 362/545
(Continued)

FOREIGN PATENT DOCUMENTS

DE 103 03 430 A1 8/2003
EP 1 298 383 A2 4/2003
(Continued)

OTHER PUBLICATIONS

Jul. 24, 2015—(EP) Extended Search Report—App 14152986.7.

*Primary Examiner* — Hargobind S Sawhney
(74) *Attorney, Agent, or Firm* — Banner & Witcoff, Ltd.

(57) ABSTRACT

A vehicle lighting device includes a light emitting unit, a holding unit, a light guide, a cover and an attachment unit. The light emitting unit has one or more light emitting elements. The holding unit holds the light emitting unit. The light guide guides light emitted from the light emitting unit and emits the light from a tip which is on a tip side opposite to a light emitting unit side. The cover has a first fixation unit to be fixed to the holding unit and a second fixation unit which has a diameter smaller than a diameter of the first fixation unit and internally fixes the light guide thereto in a state of exposing the tip. The attachment unit is formed in the second fixation unit in a shape attachable to a reflector.

9 Claims, 14 Drawing Sheets

(52) U.S. Cl.
CPC ..... *F21S48/212* (2013.01); *F21S 48/215* (2013.01); *F21S 48/2206* (2013.01); *F21S 48/2237* (2013.01); *F21S 48/2262* (2013.01); *F21S 48/2281* (2013.01); *F21S 48/24* (2013.01)

(56) References Cited

U.S. PATENT DOCUMENTS

| | | | |
|---|---|---|---|
| 2003/0147252 | A1 | 8/2003 | Fioravanti |
| 2004/0208019 | A1 | 10/2004 | Koizumi et al. |

FOREIGN PATENT DOCUMENTS

| | | | | |
|---|---|---|---|---|
| EP | 2 821 689 | A1 | | 1/2015 |
| JP | 2002190917 | A | * | 7/2002 |
| JP | 2010-129300 | A | | 6/2010 |
| JP | 2010-182554 | A | | 8/2010 |
| JP | 2011-249348 | A | | 12/2011 |
| JP | 2012084695 | A | * | 4/2012 |
| JP | 2012-243735 | A | | 12/2012 |
| WO | 03/071352 | A1 | | 8/2003 |
| WO | 2012/040280 | A2 | | 3/2012 |

* cited by examiner

VEHICLE LIGHTING DEVICE

CROSS-REFERENCE TO RELATED APPLICATIONS

This application is based upon and claims the benefit of priorities from Japanese Patent Application No. 2013-099656, filed on May 9, 2013 and Japanese Patent Application No. 2013-114683, filed on May 30, 2013; the entire contents of which are incorporated herein by reference.

FIELD

Embodiments described herein relate generally to a vehicle lighting device.

BACKGROUND

A vehicle lighting device using a light emitting element as a light source is employed in front combination lamps and rear combination lamps. When the light emitting element is used in a lighting device, thermal management for the light emitting element is one important item. This is because the light emitting element has characteristics that light emitting efficiency is decreased due to a temperature rise of the element itself. In particular, in order to be mounted on a vehicle, the vehicle lighting device needs to maintain a function under an operating environment from a low temperature environment of −40° C. to a high temperature environment of 85° C. In this regard, the thermal management under the high temperature environment is important. In addition, the vehicle lighting device needs to be miniaturized, thereby precluding a heat radiating area from being sufficiently secured. Accordingly, the thermal management becomes more important. If a plurality of LED units previously unitized to be mountable on a board is simply mounted on a printed circuit board, the printed circuit board is increased in size, thereby resulting in an inevitably increased size of the vehicle lighting device. Incidentally, the lighting device includes those which have a light guide for guiding light emitted from the light emitting element.

If the thermal management or the fact that the printed circuit board is internally accommodated is considered, miniaturization of the vehicle lighting device cannot be achieved. As a result, an outer diameter of the vehicle lighting device is increased. An attachment unit in which the vehicle lighting device is attached to a lamp, for example, which emits the light from the vehicle lighting device, is disposed on an outer peripheral surface of the vehicle lighting device. In this case, the attachment unit is caused to have the larger outer diameter according to the diameter of the vehicle lighting device. In this regard, when the vehicle lighting device is generally attached to the lamp, a portion of the vehicle lighting device is protruded into the lamp. For this reason, an insertion port for inserting the vehicle lighting device is formed in the lamp. Since the attachment unit is attached to the lamp in the vicinity of the insertion port, the insertion port is increased in size so as to match the outer diameter of the vehicle lighting device. Therefore, if the diameter of the vehicle lighting device is increased, when a front surface of the vehicle lighting device is viewed from outside of the lamp, there is a problem in that a proportion occupied by a light non-emitting region which does not emit the light is relatively increased as compared to a light emitting region which emits the light such as the light emitting element.

The exemplary embodiments described herein aim to provide a vehicle lighting device which can decrease the proportion occupied by the light non-emitting region with respect to the light emitting region when viewed from the front.

DETAILED DESCRIPTION

Figure 1:
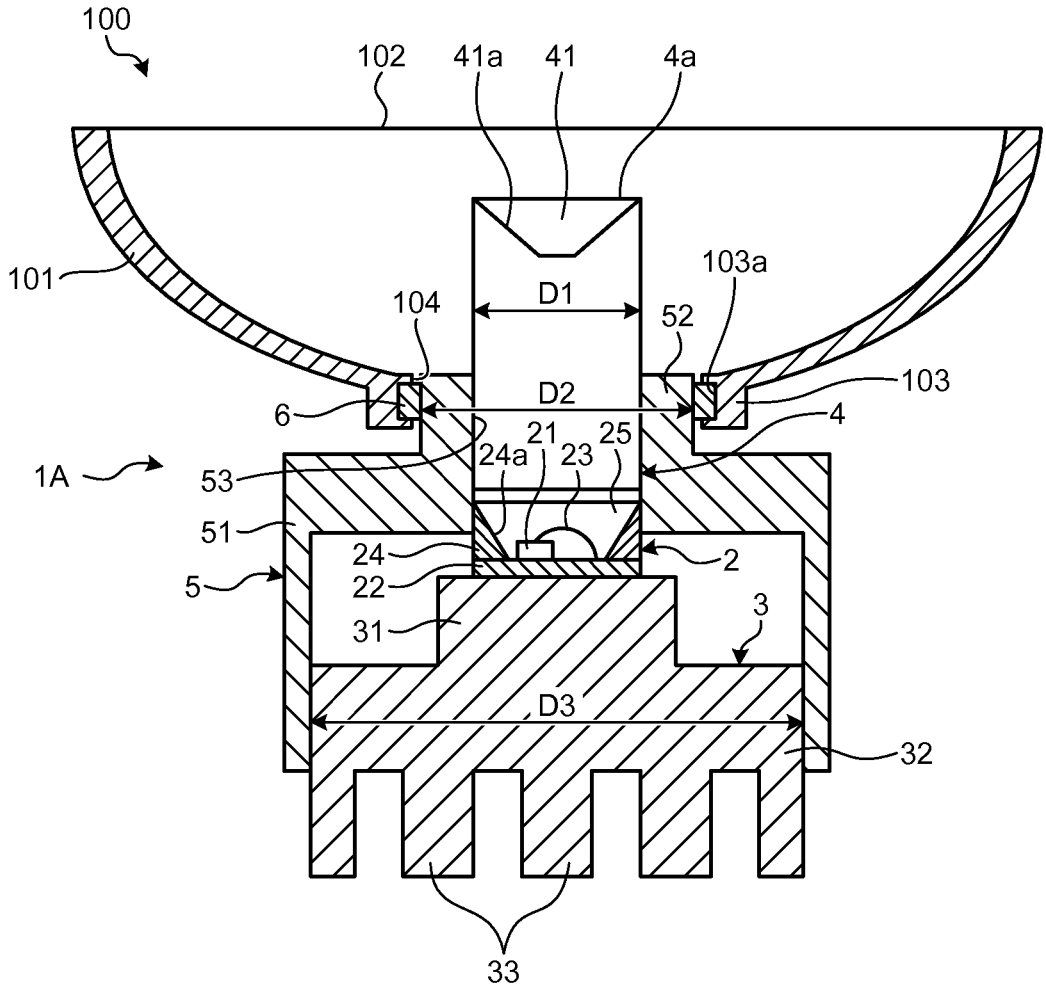
FIG. 1 illustrates a relationship between a vehicle lighting device and a lamp according to a first embodiment.

Vehicle lighting devices 1A to 1I according to embodiments described below include a light emitting unit 2, a holding unit 3, a light guide 4, a cover 5 and an attachment unit 6. The light emitting unit 2 has one or more light emitting elements 21. The holding unit 3 holds the light emitting unit 2. The light guide 4 guides light emitted from the light emitting unit 2 and emits the light from a tip 4*a* which is an opposite side to the light emitting unit 2 side. The cover 5 has a first fixation unit 51 to be fixed to the holding unit 3 and a second fixation unit 52 which has a diameter smaller than that of the first fixation unit 51 and internally fixes the light guide 4 thereto in a state of exposing the tip 4*a*. The attachment unit 6 attaches the vehicle lighting devices 1A to 1I to a light emitting object (lamp) 100 to which the light guided from the light guide 4 is emitted, and is formed in the second fixation unit 52.

In addition, in the vehicle lighting devices 1A to 1I according to the embodiments, the light guide 4 has a cylindrical shape, and a ratio D1/D2 of an outer diameter D1 of the light guide 4 to an outer diameter D2 of the second fixation unit 52 has a relationship of $0.1 \leq D1/D2 \leq 0.9$.

In addition, in the vehicle lighting devices 1A, 1B and 1H according to the embodiments, the tip 4*a* of the light guide 4 has a recess 41.

In addition, in the vehicle lighting device 1B according to the embodiment, the recess 41 has a recessed surface 41*a* with which reflection materials 42 to 44 or scattering materials are in close contact.

In addition, in the vehicle lighting devices 1A to 1I according to the embodiments, the cover 5 to which the light guide 4 is fixed is attachable to and detachable from the holding unit 3.

In addition, in the vehicle lighting devices 1D to 1H according to the embodiments, the cover 5 has an opening 53 to which the light guide 4 is inserted in a state of exposing the tip 4*a*, and accommodates a portion of the light guide 4 and the light emitting unit 2 in a space S formed between the holding unit 3 and the cover 5. In addition, the light guide 4 has light guide fixation portions 47*a* and 47*b* to be fixed to the cover 5 in a state of being inserted into the opening 53, and has an outer diameter D12 from the light guide fixation portions 47*a* and 47*b* to the tip 4*a* side, which is larger than an outer diameter D11 from the light guide fixation portions 47*a* and 47*b* to the light emitting unit 2 side.

In addition, in the vehicle lighting devices 1D, and 1F to 1H according to the embodiments, the cover 5 has a positioning portion 54 which opposes the light guide 4 in a radial direction of the light guide 4, and at least one of the positioning portions 54 is formed in the space S in a circumferential direction.

In addition, in the vehicle lighting devices 1D to 1H according to the embodiments, the light guide fixation portions 47*a* and 47*b* are protruded in the radial direction of the light guide 4, and at least one of the light guide fixation portions 47*a* and 47*b* is formed in the circumferential direction.

In addition, in the vehicle lighting devices 1D, 1E and 1H according to the embodiments, an outer diameter D13 of the light guide fixation portion 47*a* is larger than the outer diameter D12 from the light guide fixation portion 47*a* to the tip 4*a* side, and the light guide fixation portion 47*a* is internally fixed to the cover 5 inside the cover 5.

In addition, in the vehicle lighting device 1G according to the embodiment, the light guide fixation portion 47*b* is externally fixed to the cover 5 outside the cover 5.

In addition, in the vehicle lighting device 1I according to the embodiment, the cover 5 has the opening 53 to which the light guide 4 is inserted in a state of exposing the tip 4*a*, and accommodates a portion of the light guide 4 and the light emitting unit 2 in the space S formed between the holding unit 3 and the cover 5. In addition, the light guide 4 has a light guide fixation portion 47*c* to be fixed to the cover 5 in a state of being inserted into the opening 53. The outer diameter D12 from the light guide fixation portion 47*c* to the tip 4*a* side is the same as the outer diameter D11 from the light guide fixation portion 47*c* to the light emitting unit 2 side, and the outer diameter D13 of the light guide fixation portion 47*c* is larger than the outer diameter D12 from the light guide fixation portion 47*c* to the tip 4*a* side.

Hereinafter, the vehicle lighting devices according to the embodiments will be described with reference to the drawings. The same reference numerals are given to the same elements in the embodiments, and description thereof will be omitted.

First Embodiment

Figure 2:
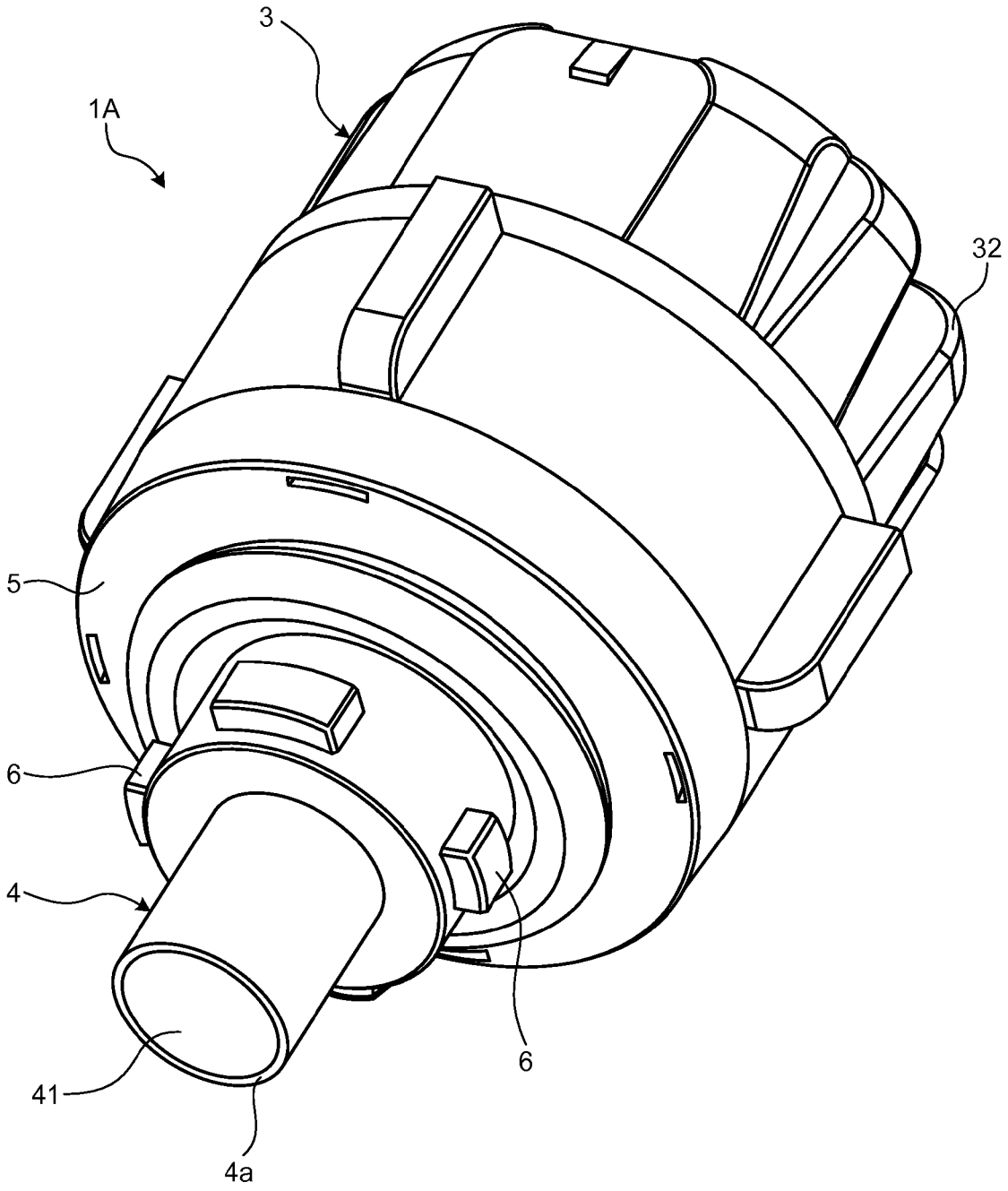
FIG. 2 is a perspective view illustrating the vehicle lighting device according to the first embodiment.
Figure 3:
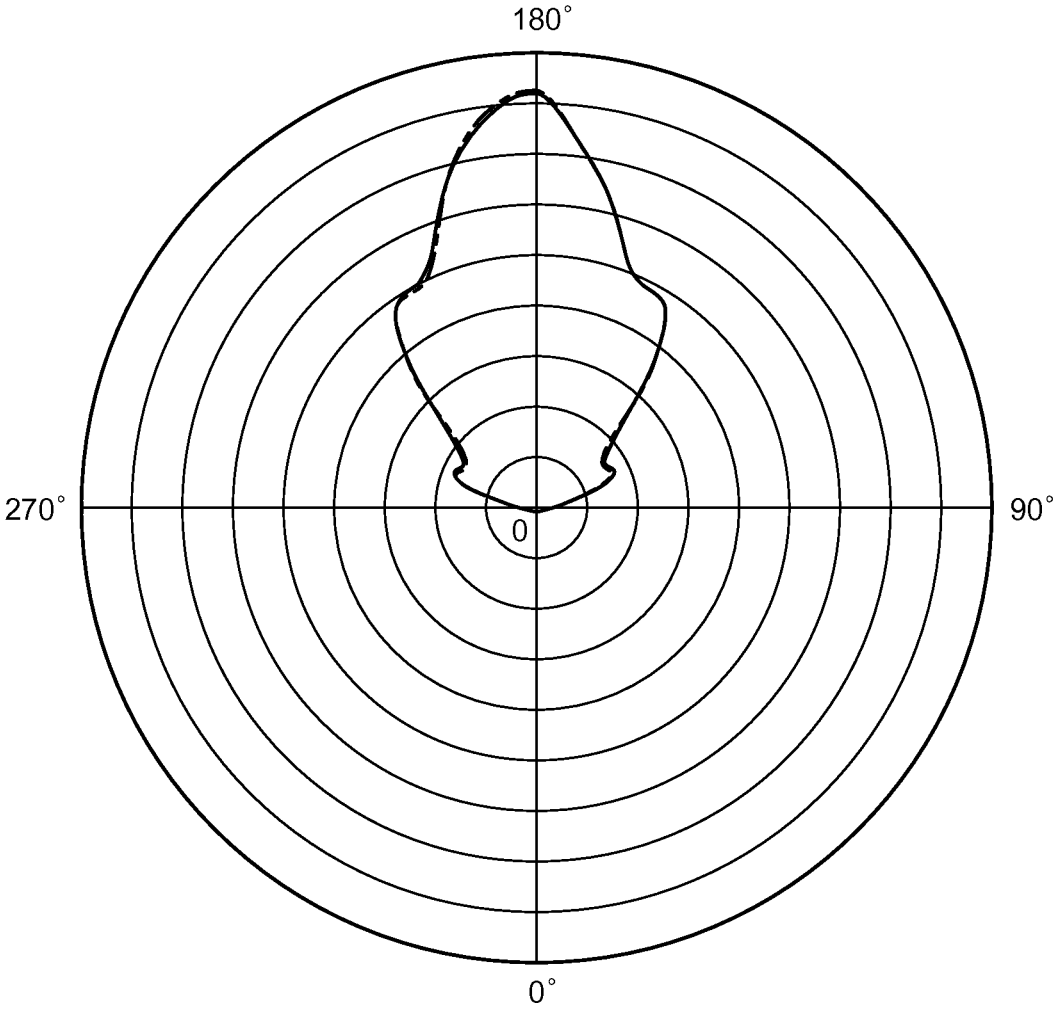
FIG. 3 illustrates light distribution characteristics according to the first embodiment.
Figure 5:
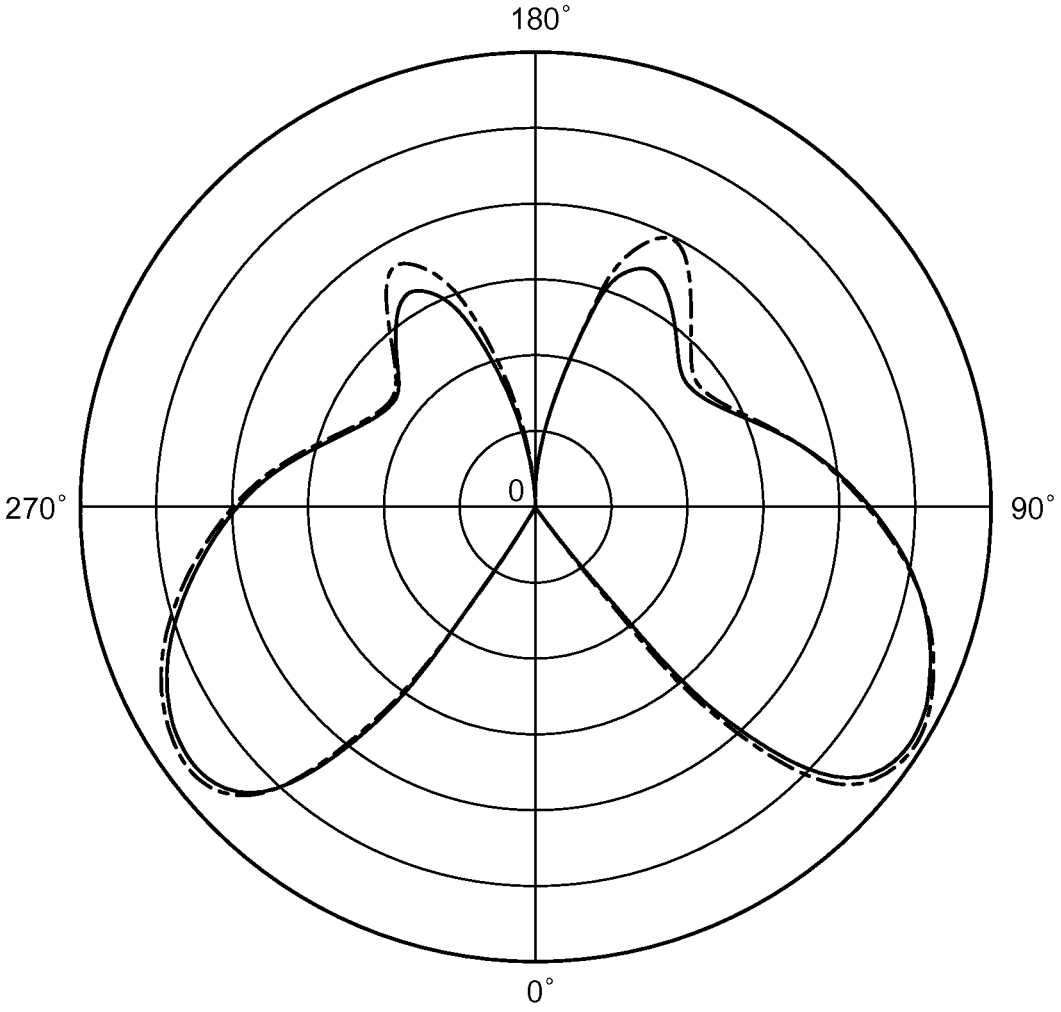
FIG. 5 illustrates light distribution characteristics according to the second embodiment.
Figure 11:
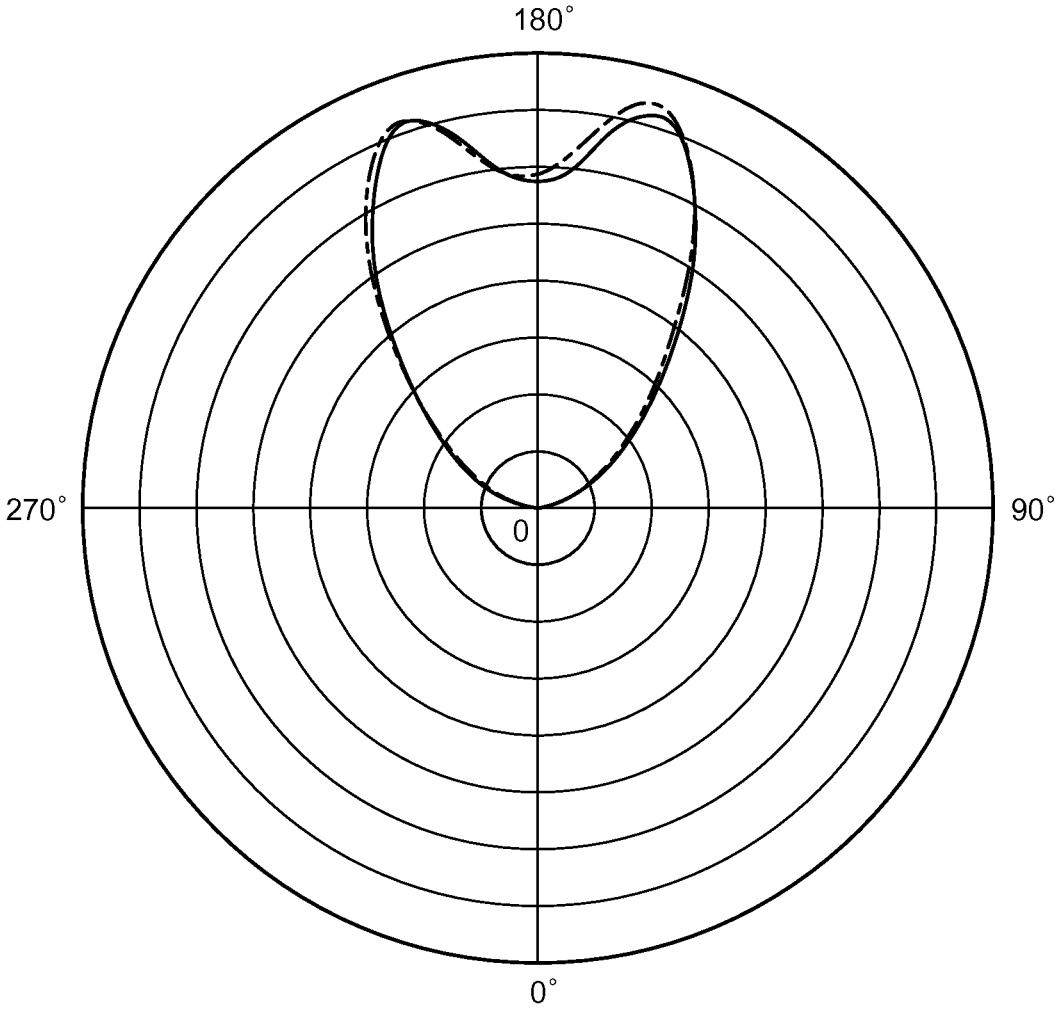
FIG. 11 illustrates light distribution characteristics according to the third embodiment.

A first embodiment will be described with reference to FIGS. 1 to 3. FIG. 1 illustrates a relationship between a vehicle lighting device and a lamp according to the first embodiment. FIG. 2 is a perspective view illustrating the vehicle lighting device according to the first embodiment. FIG. 3 illustrates light distribution characteristics of the vehicle lighting device according to the first embodiment. In FIG. 3 (FIGS. 5 and 11 are also the same), an axis in a radial direction represents intensity of light emitted from the vehicle lighting device (intensity of light is stronger outward), and an axis in a circumferential direction represents an emitting angle. In addition, a solid line illustrated in FIG. 3 represents the light distribution characteristics on a horizontal plane, and a one-dot chain line illustrated in FIG. 3 represents the light distribution characteristics on a vertical plane orthogonal to the horizontal plane. An upward direction from the paper surface in FIG. 3 represents a light emitting direction.

A vehicle lighting device 1A of the present embodiment is a vehicle lighting device which is used in an exterior or an interior of a vehicle, and for example, includes a stop lamp, a tail lamp, a turn signal lamp and a fog lamp which configure front combination lamps and rear combination lamps. As illustrated in FIG. 1, in the present embodiment, the vehicle lighting device 1A emits the light to a lamp 100. The vehicle lighting device 1A is configured to include the light emitting unit 2, the holding unit 3, the light guide 4, the cover 5 and the attachment unit 6. In the vehicle lighting device 1A, the light emitting unit 2 and the holding unit 3 are accommodated in the cover 5 and the light guide 4 is fixed to the cover 5. In the present embodiment, one vehicle lighting device 1A is mounted on the lamp 100. However, without being limited thereto, two or more vehicle lighting devices 1A may be mounted on the lamp 100.

Here, the lamp 100 is a light emitting object, and emits the light emitted from the vehicle lighting device 1A, that is, emits the light emitted from the light guide 4 outward using predetermined light distribution. In the present embodiment, the lamp 100 emits the light outward from a vehicle (not illustrated). The lamp 100 is configured to include a reflector 101, a lens 102 and a reception unit 103. In the lamp 100, the lens 102 is exposed outward from the vehicle, and the reflector 101 and the vehicle lighting device 1A are arranged inside the vehicle.

The reflector 101 is formed in a concave shape, and is arranged to surround the vehicle lighting device 1A. The reflector 101 is generally formed of a resin material, and an inner peripheral surface thereof has a reflection layer formed by using a reflection material such as aluminum. In this manner, the inner peripheral surface of the reflector 101 is formed as a reflection surface (mirror surface). The reflector 101 has an insertion port 104 for internally exposing the vehicle lighting device 1A. A portion of a second fixation unit 52 (to be described later) of the cover 5 is inserted into the insertion port 104 of the reflector 101, and a portion between the reflector 101 and the vehicle lighting device 1A is sealed with a packing (not illustrated).

The lens 102 is a clear lens which is formed of a material having transparency, for example, in the present embodiment, a transparent colorless resin material or glass, and is adapted to close an interior of the reflector 101. Since the lens 102 has transparency, the light emitted from the vehicle lighting device 1A or the light reflected on the reflection surface of the reflector 101 is transmitted through the lens 102 and emitted outward from the lamp 100, that is, emitted outward from the vehicle.

The reception unit 103 supports and fixes the vehicle lighting device 1A to the lamp 100 by engaging with the attachment unit 6 of the vehicle lighting device 1A. The reception unit 103 is formed to protrude to both of the lens 102 side and the opposite side of the insertion port 104, and has a space portion 103*a* to which the attachment unit 6 is inserted. The reception unit 103 is formed to have the number corresponding to the number of the attachment units 6 (to be described later), and is arranged around the insertion port 104. A distance between the adjacent reception units 103 is set so that the attachment unit 6 can be inserted in the axial direction of the vehicle lighting device 1A. In addition, an opening (not illustrated) which communicates with the space portion 103*a* is formed on one lateral surface within lateral surfaces in the circumferential direction of the reception unit 103.

The light emitting unit 2 emits the light and for example, has the light emitting element 21 mounted on a substrate 22 having heat radiation performance. The light emitting element 21 is a light emitting semiconductor device such as an LED and an LD. One or more light emitting elements 21, in the present embodiment, a plurality of light emitting elements is directly mounted on the substrate 22 in series or in parallel. As illustrated in FIG. 1, each light emitting element 21 is electrically connected to the substrate 22 via a wire 23. The light emitting unit 2 is disposed so that all light emitting elements 21 are surrounded by the reflector 24 which reflects the light emitted from each light emitting element 21. The reflector 24 has a tilted surface 24*a* in which an inner peripheral surface thereof is widened from the substrate 22 side to the light guide 4 side. In the light emitting unit 2, in order to prevent damage to each light emitting element 21 and cutting of the wire 23, a resin 25 having the transparency is filled with a space portion generated by the reflector 24, that is, a light emitting container for containing each light emitting element 21. In this manner, each light emitting element 21 is sealed with the resin. Therefore, since the plurality of light emitting elements 21 is accommodated in the reflector 24, it is possible to decrease the light source in size and to miniaturize the substrate as compared to a case where a plurality of LED units previously unitized so as to be mountable on the substrate is mounted on the printed circuit board. The substrate 22 is a mounting substrate for mounting each light emitting element 21 and a driving substrate for mounting a drive circuit which supplies power to the light emitting unit 2. The substrate 22 is configured so that the light guide 4 side serves as a component placement surface, and each light emitting element 21 described above and a control element (not illustrated) to control the reflector 24 or each light emitting element 21 are mounted thereon. The substrate 22 is configured so that an opposite side to the component placement surface serves as heat radiation surface, and is fixed in a contact state with a mount 31 of the holding unit 3 in the present embodiment. In addition, the substrate 22 is an insulating substrate formed of materials in which the heat generated by the light emitting element 21 is easily transferred, such as metal or ceramic having high heat conductivity. The substrate 22 is connected to a power supply member (not illustrated). The power supply member is electrically connected to an external power source (not illustrated) disposed outside the vehicle lighting device 1A. Accordingly, the power of the external power source is supplied to each light emitting element 21 via the power supply member. Each light emitting element 21 may be connected to the power supply member either in parallel or in series.

The holding unit 3 holds the light emitting unit 2 and also serves as a heat radiation member which radiates heat from the light emitting unit 2. Within the holding unit 3, a main body 32 including the mount 31 on which the light emitting unit 2 is placed is configured to have a resin material. In the present embodiment, as illustrated in FIG. 1, in order to improve heat radiation performance, a heat sink 33 formed of a metallic material is attached to the main body 32 configured to have the resin material. The heat sink 33 is to expand a surface area exposed outward of the holding unit 3. Accordingly, an area for the heat radiation is improved and a heat radiation effect is improved. The main body 32 and the heat sink 33 of the holding unit 3 may be integrally molded with the resin having high heat radiation.

The light guide 4 guides the light emitted from the light emitting unit 2 and emits the light to the lamp 100. The light guide 4 is formed in a cylindrical shape and emits the light from the light emitting unit 2, which is guided from the tip 4*a* of the opposite side to the light emitting unit 2 side. For example, the light guide 4 is formed of a material having high light transmittance such as transparent acrylic resin, glass and polycarbonate. The light guide 4 is arranged so that the opposite side to the tip 4*a* opposes the light emitting unit 2 in the axial direction. In order to guide all of the light or most of the light emitted from the light emitting unit 2, the light guide 4 is in contact with or is optically connected to the light emitting unit 2 with a slight gap. That is, the light emitted from the light emitting unit 2 is incident through the end portion of the light emitting unit 2 side of the light guide 4, is totally reflected inside the light guide 4 and is emitted outward from the tip 4*a*, that is, emitted into the lamp 100.

Here, the light guide 4 in the present embodiment has a recess 41 in the tip 4*a*. The recess 41 is formed in a circular truncated conical shape (trapezoidal shape to be flared toward the tip 4*a* in a cross-sectional shape on a plane including the axis of the light guide 4), and acts as a space portion communicating with the outside. Accordingly, the light emitted to an axially tilted portion within a recessed surface 41*a* which is a boundary surface between the light guide 4 having the recess 41 and the outside is condensed in the light emitting direction. The light guide 4 in the present embodiment is formed of a transparent resin material such as acrylic in a cylindrical shape of 9 mm in outer diameter and 24 mm in height. The recess 41 is in the circular truncated conical shape in which the diameter is 9 mm in the tip 4*a* and the depth is 5 mm, and the diameter is 4 mm in the bottom surface (end portion inside the light guide 4).

The cover 5 fixes the holding unit 3 and the light guide 4, and is configured to include the first fixation unit 51, the second fixation unit 52 and the opening 53. The first fixation unit 51 is fixed to the holding unit 3 and is formed in a bottomed cylindrical shape. The first fixation unit 51 together with the holding unit 3 is adapted to close the light emitting unit 2 to be protected from the outside. The first fixation unit 51 internally communicates with the opening 53. In the present embodiment, if the first fixation unit 51 is fixed to the main body 32 of the holding unit 3, a portion of the light emitting unit 2 is left in a state of being inserted into the opening 53. Accordingly, it is possible to prevent the light emitted from the light emitting unit 2 from being emitted to between the first fixation unit 51 and the holding unit 3. The first fixation unit 51 is fixed to the holding unit 3 via a packing (not illustrated) configured to have an elastic material. That is, it is possible to prevent the outside atmosphere from entering through a portion fixed to the holding unit 3 of the cover 5 by using the packing. The first fixation unit 51 is fixed to the main body 32 so that the heat sink 33 is protruded outward further than the first fixation unit 51. The second fixation unit 52 internally fixes the light guide 4. The second fixation unit 52 has a cylindrical shape and internally has the opening 53. Here, the outer diameter D2 of the second fixation unit 52 is set to be smaller than the outer diameter D3 of the first fixation unit 51. It is preferable that the outer diameter D2 of the second fixation unit 52 be as small as possible so as to approach the outer diameter D1 of the light guide 4, on the assumption that when the vehicle lighting device 1A is attached to the lamp 100 by using the attachment unit 6, the second fixation unit 52 sufficiently withstands the external force during the travelling of the vehicle and when the vehicle lighting device 1A is attached to or detached from the lamp 100. The second fixation unit 52 fixes the light guide 4 inserted into the opening 53 in a state of exposing the tip 4*a*.

Here, a ratio D1/D2 of the outer diameter D1 of the light guide 4 to the outer diameter D2 of the second fixation unit 52 has a relationship of $0.1 \leq D1/D2 \leq 0.9$. If the ratio D1/D2 is less than 0.1, a proportion occupied by the light non-emitting region greatly causes design quality to be degraded. In contrast, if the ratio D1/D2 is beyond 0.9, the strength of the attachment unit 6 is weakened, and thus damage occurs due to vibrations and shocks.

The attachment unit 6 is adapted to attach the vehicle lighting device 1A to the lamp 100 which is the light emitting object. The attachment unit 6 is formed in the second fixation unit 52 and engages with the reception unit 103. The attachment unit 6 of the present embodiment is configured so that a plurality of attachment units 6 is formed in the circumferential direction of the second fixation unit 52. When the vehicle lighting device 1A is attached to the lamp 100 by using the attachment unit 6, the tip 4*a* of the light guide 4 is first inserted into the insertion port 104 from the opposite side to the lens 102 side, and the second fixation unit 52 is inserted into the insertion port 104 until each attachment unit 6 opposes each reception unit 103 in the circumferential direction. Then, the vehicle lighting device 1A is rotated around the axis of the lamp 100, and each attachment unit 6 is inserted into each space portion 103*a* from the opening. Thus, each attachment unit 6 is engaged with each reception unit 103. In this manner, the vehicle lighting device 1A is attached to the lamp 100 in a state where the tip 4*a* of the light guide 4 is exposed to the inside of the lamp 100.

Next, an operation of the vehicle lighting device 1A will be described. The vehicle lighting device 1A is fixed to the lamp 100 as described above, and the power supply member is electrically connected to the external power source. If the power supply from the external power source is started, the power supplied from the external power source to the substrate 22 via the power supply member is supplied to each light emitting element 21 and each light emitting element 21 emits the light using the supplied power, thereby allowing the light emitting unit 2 to emit the light. The light emitted from the light emitting unit 2 is emitted to the light guide 4 from the end surface opposing to the light emitting unit 2 inside the opening 53. The light guided into the light guide 4 is emitted into the lamp 100 from the tip 4*a*, passes through the lens 102 from the inside of the lamp 100, and is emitted outward, that is, is emitted outward from the vehicle.

Here, as illustrated in FIG. 3, in the light distribution characteristics of the light emitted from the vehicle lighting device 1A, the light is emitted so as to be condensed from the vehicle lighting device 1A, that is, from the tip 4*a* of the light guide 4 toward the light emitting direction. In particular, the intensity of the light emitted toward the light emitting direction is adapted to be the strongest. Accordingly, the vehicle lighting device 1A can obtain the light distribution characteristics having a directional strongpoint in the light emitting direction by forming the recess 41 in the light guide 4. That is, if the recess 41 is formed in the light guide 4, as compared to a case without forming the recess 41, it is possible to adjust the directivity of the light, and thus it is possible to obtain desired light distribution characteristics.

As described above, in the vehicle lighting device 1A according to the present embodiment, the outer diameter D2 of the second fixation unit 52 to which the light guide 4 is fixed in a state of exposing the tip 4*a* is smaller than the outer diameter D3 of the first fixation unit 51, and the vehicle lighting device 1A is attached to the lamp 100 by using the attachment unit 6 formed in the second fixation unit 52. Accordingly, it is possible to decrease the outer diameter of the attachment unit 6, and it is possible to decrease the diameter of the insertion port 104 through which the vehicle lighting device 1A of the lamp 100 is protruded. In addition, a portion exposed to the lamp 100 within the vehicle lighting device 1A is the light guide 4 and the second fixation unit 52. That is, it is possible to arrange the first fixation unit 51 so as not to be visible from the lamp 100. Accordingly, when the vehicle lighting device 1A is viewed from the front, it is possible to decrease the proportion occupied by the cover 5 which is the light non-emitting region with respect to the light guide 4 which is the light emitting region. In this manner, when the vehicle lighting device 1A is viewed from the outside of the lamp 100, it is possible to prevent the cover 5 from being noticeable, and it is possible to reduce the influence of the light non-emitting region on the design quality of the lamp 100.

In addition, the second fixation unit 52 having the attachment unit 6 attached to the lamp 100 is a separate member from the light guide 4. Accordingly, it is possible to change a fixing position of the light guide 4 with respect to the second fixation unit 52 in the axial direction. Therefore, it is possible to change the height of the tip 4*a* of the light guide 4 with respect to the lamp 100. As a result, it is possible to optionally change the light distribution characteristics of the vehicle lighting device 1A with respect to the lamp 100.

In addition, the light emitting unit 2 can be separated from the lamp 100. Accordingly, it is possible to prevent the lamp 100 from being affected by thermal deformation, for example, due to the heat radiation from the vehicle lighting device 1A. In addition, it is possible to prevent the heat from being radiated into the lamp 100 which is likely to accumulate the heat through the vehicle lighting device 1A. Accordingly, it is possible to prevent the heat radiation performance from being degraded due to the attachment of the vehicle lighting device 1A to the lamp 100. In addition, as compared to a shape of the first fixation unit 51 which is determined by a shape of the substrate 22 or the like, a shape of the second fixation unit 52 has no limitation if the attachment unit 6 can be formed and the light guide 4 can be internally fixed. Accordingly, it is possible to optionally select a shape of the light non-emitting region, that is, a shape of the second fixation unit 52 when the vehicle lighting device 1A is viewed from the outside of the lamp 100. In this manner, it is possible to improve the design quality of the vehicle lighting device 1A.

In the first embodiment described above, the recess 41 having the circular truncated conical shape has been described. However, the shape of the recess 41 is not limited thereto. The shape may be formed in a bottomed cylinder shape (for example, horizontal bottom surface), a conical shape, an elliptical conical shape or the like. In addition, in the recess 41, an outer peripheral line in the cross-sectional shape may be either a straight line or a curve. In addition, an outer peripheral surface of the tip 4*a* of the light guide 4 may be formed, for example, so as to be flared from the tip 4*a* side to the light emitting unit 2 side, that is, may be formed in a tapered shape.

In addition, in the first embodiment described above, the recessed surface 41*a* of the recess 41 may be formed to have a rough surface. For example, the recessed surface 41*a* is formed to have the rough surface so that surface roughness Ra of the recessed surface 41*a* is equal to or greater than 0.2. Accordingly, the light incident on the recessed surface 41*a* is scattered and emitted outward from the recessed surface 41*a* since the recessed surface 41*a* is the rough surface. Therefore, it is possible to change the light distribution characteristics determined when the recessed surface 41*a* is not formed to have the rough surface so as to be different light distribution characteristics. For example, it is possible to change the light distribution characteristics so as to have an incandescent bulb shape.

Second Embodiment

Figure 4:
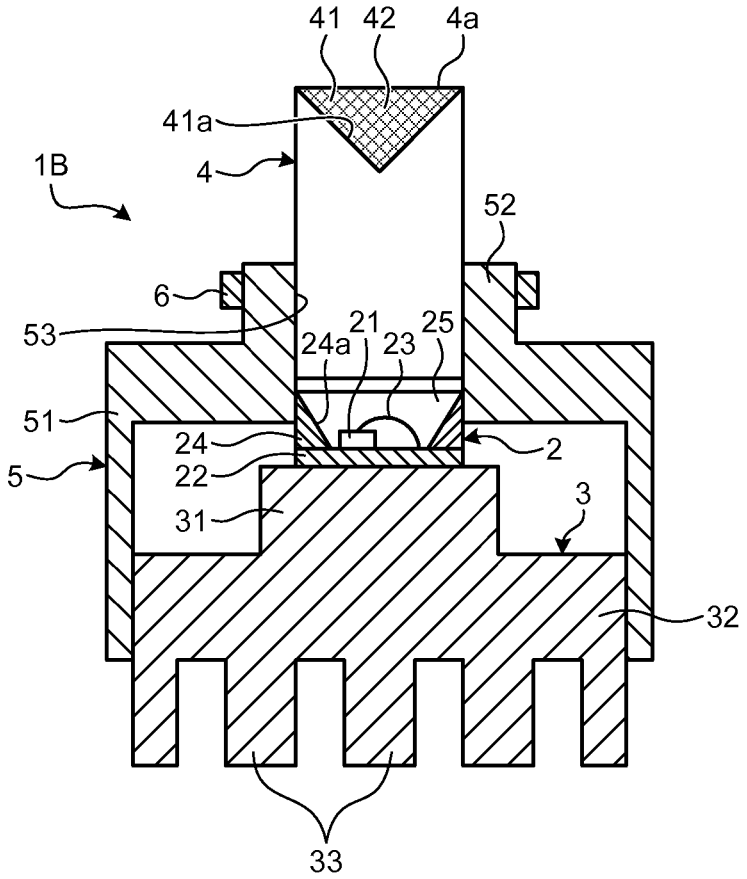
FIG. 4 illustrates a vehicle lighting device according to a second embodiment.

Next, a second embodiment will be described. FIG. 4 illustrates a vehicle lighting device of the second embodiment. FIG. 5 illustrates light distribution characteristics of the vehicle lighting device of the second embodiment. A vehicle lighting device 1B illustrated in FIG. 4 is different from the vehicle lighting device 1A in that the reflection material 42 is in close contact with the recessed surface 41*a* of the recess 41.

The recess 41 of the light guide 4 has a conical shape. The recess 41 is filled with the reflection material 42, thereby bringing the reflection material 42 into close contact with the recessed surface 41*a*. For example, the reflection material 42 is a material in which the same material as the material forming the light guide 4 is used as a base material and reflection materials (white particles of titanium oxide, barium sulfate, calcium carbonate and the like) are included. A filling portion formed to have the reflection material 42 may be integrally molded with the light guide 4 or may be optically connected to the light guide 4 using a separate member. The reflection material 42 is configured so that the light incident on the reflection material 42 emitted from the light guide 4 is reflected into the light guide 4. Accordingly, the light is prevented from being emitted outward of the light guide 4 from the reflection material 42. The light guide 4 in the present embodiment is formed of the transparent resin material such as acrylic, in a cylindrical shape where the outer diameter is 9 mm and the height is 24 mm. The recess 41 is formed in a conical shape where the diameter in the tip 4*a* is 9 mm and the depth is 5 mm.

Here, the light distribution characteristics of the light emitted from the vehicle lighting device 1B are as follows. As illustrated in FIG. 5, the light is rarely emitted from the vehicle lighting device 1B, that is, from the tip 4*a* of the light guide 4, in the light emitting direction. The light is mostly emitted from the outer periphery of the light guide 4. In particular, the light is emitted diagonally further rearward (to the light emitting unit 2 side and radially outward of the light guide 4) from the tip 4*a* of the light guide 4. Accordingly, in the vehicle lighting device 1B, the recess 41 is filled with the reflection material 42 so that the reflection material 42 is brought into close contact with the recessed surface 41*a*. Accordingly, it is possible to obtain the light distribution characteristics having a directional strongpoint in a sideway direction orthogonal to the light emitting direction or in a rearward direction opposite to the light emitting direction. That is, if the reflection material 42 is brought into contact with the recessed surface 41*a* of the light guide 4, as compared to a case of forming only the recess 41, it is possible to adjust the directivity of the light, and thus it is possible to obtain desired light distribution characteristics.

Figure 6:
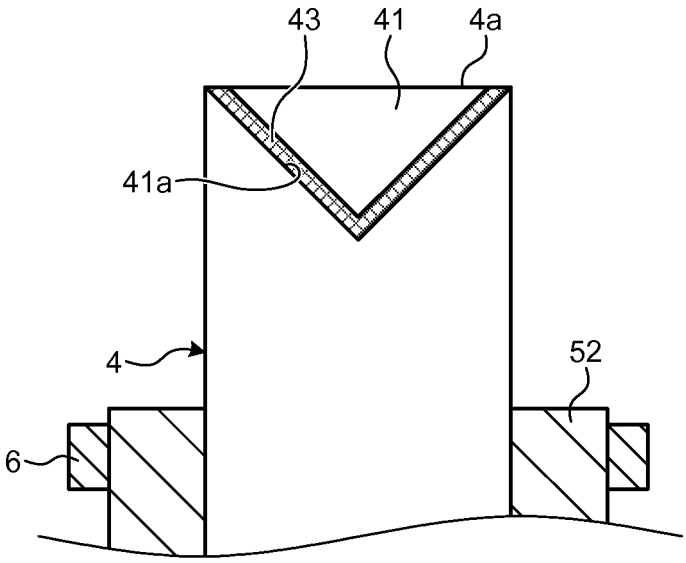
FIG. 6 illustrates a first modification example according to the second embodiment.
Figure 7:
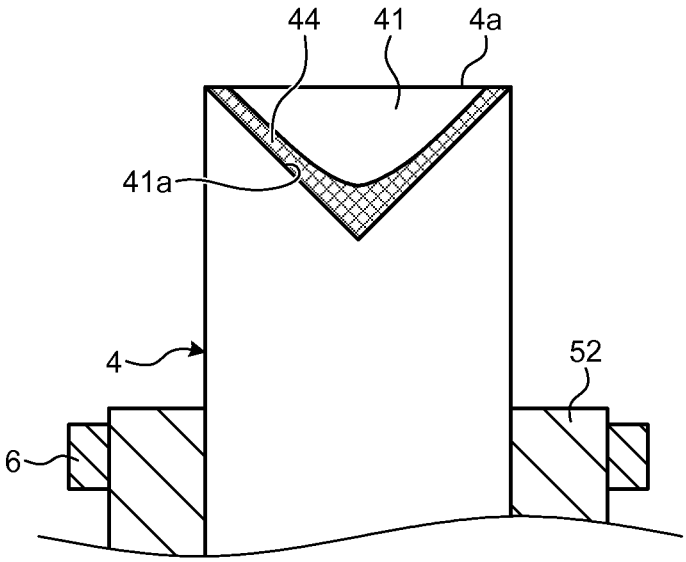
FIG. 7 illustrates a second modification example according to the second embodiment.

In addition, in the second embodiment described above, the recess 41 is filled with the reflection material 42, but the configuration is not limited thereto. FIG. 6 illustrates a first modification example of the vehicle lighting device of the second embodiment. FIG. 7 illustrates a second modification example of the vehicle lighting device of the second embodiment. For example, as illustrated in FIG. 6, a reflection material 43 may be brought into close contact with the recessed surface 41*a* by bonding the reflection material 43 formed from a sheet-like member to the recessed surface 41*a* of the recess 41 using a transparent adhesive. In addition, for example, as illustrated in FIG. 7, a reflection material 44 may be brought into close contact with the recessed surface 41*a* without filling the whole recess 41 by applying and drying the reflection material 44 having a liquid state or a paste state to the recessed surface 41*a* of the recess 41.

Figure 8:
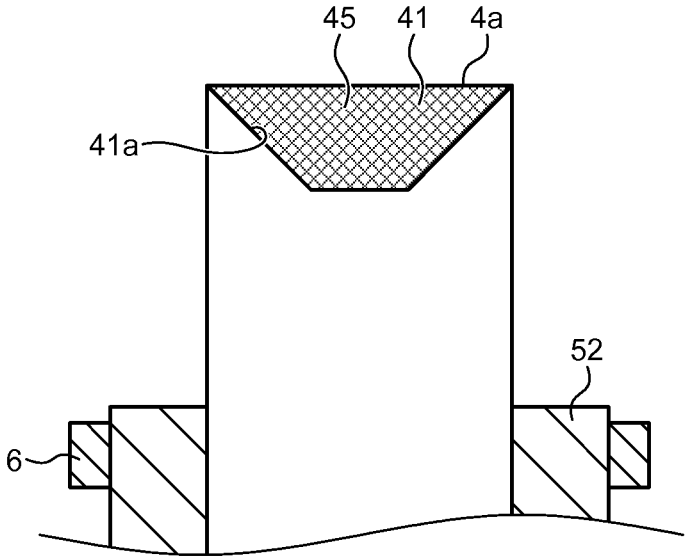
FIG. 8 illustrates a third modification example according to the second embodiment.
Figure 9:
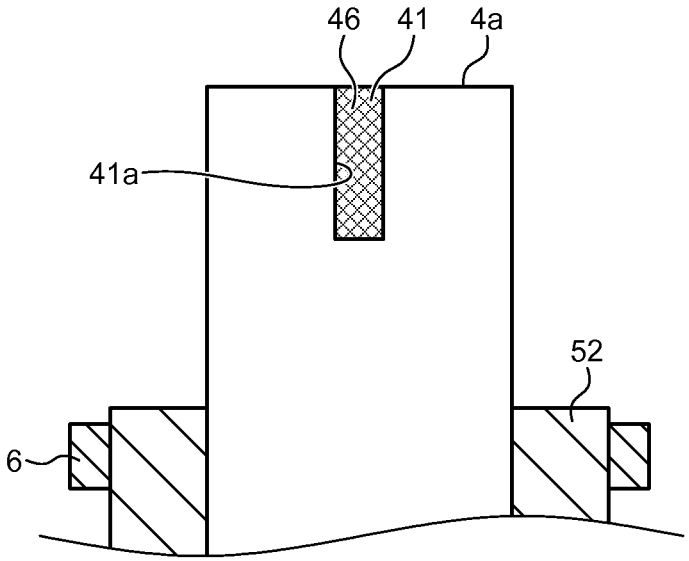
FIG. 9 illustrates a fourth modification example according to the second embodiment.

In addition, in the second embodiment described above, the reflection materials 42 to 44 are brought into close contact with the recessed surface 41*a*, but a scattering material may be brought into close contact with the recessed surface 41*a*. For example, the scattering material is a material in which the same material as the material forming the light guide 4 is used as a base material and scattering materials (scattering particles of titanium oxide, barium sulfate, calcium carbonate and the like) are included. If the scattering material is brought into close contact with the recessed surface 41*a*, the light incident on the scattering material via the recessed surface 41*a* is scattered and emitted outward from the recess 41. Accordingly, it is possible to change the light distribution characteristics determined when the recessed surface 41*a* is not formed to have the rough surface so as to be different light distribution characteristics. FIG. 8 illustrates a third modification example of the vehicle lighting device of the second embodiment. FIG. 9 illustrates a fourth modification example of the vehicle lighting device of the second embodiment. For example, as illustrated in FIG. 8, a scattering material 45 may be brought into close contact with the recessed surface 41*a* by filling the circular truncated cone-shaped recess 41 with the scattering material 45. In this case, it is possible to change the light distribution characteristics so as to have light distribution spreading all around the periphery. For example, as illustrated in FIG. 9, a scattering material 46 may be brought into close contact with the recessed surface 41*a* by filling a bottomed cylindrical recess 41 with the scattering material 46. In this case, it is possible to change the light distribution characteristics so as to have light distribution where the light is emitted while being diffused from the tip 4*a* of the light guide 4 to the light emitting direction. The light guide 4 in FIG. 9 is formed of the transparent resin material such as acrylic in a cylindrical shape of 9 mm in outer diameter and 24 mm in height. The recess 41 is formed in a cylindrical shape where the diameter in the tip 4*a* is 2.5 mm and the depth is 5 mm.

Third Embodiment

Figure 10:
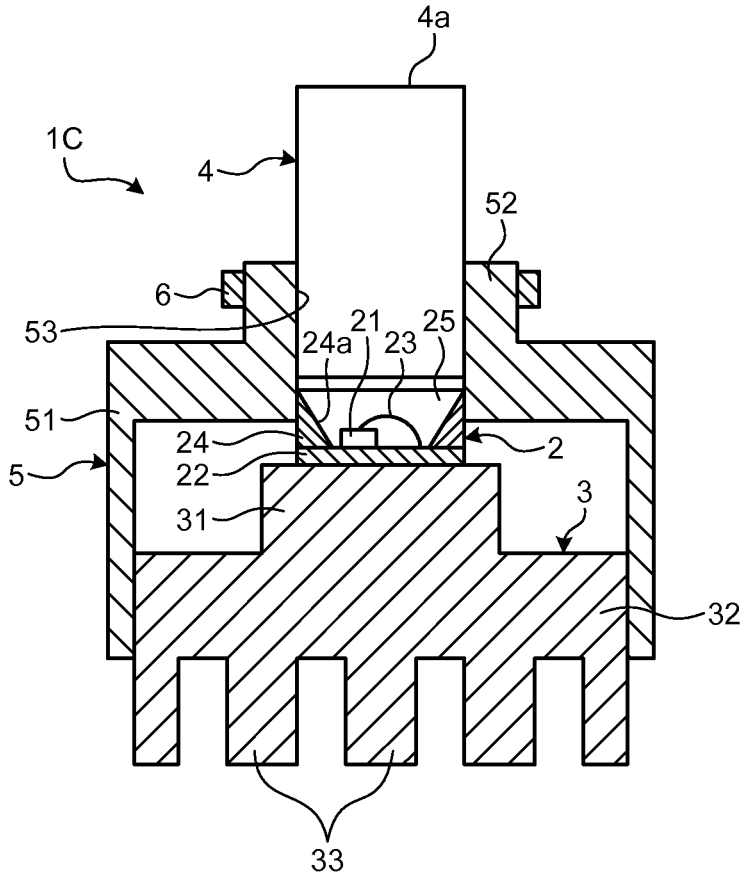
FIG. 10 illustrates a vehicle lighting device according to a third embodiment.

Next, a third embodiment will be described. FIG. 10 illustrates a vehicle lighting device of the third embodiment. FIG. 11 illustrates light distribution characteristics of the vehicle lighting device of the third embodiment. A vehicle lighting device 1C illustrated in FIG. 10 is different from the vehicle lighting device 1A in that the recess 41 is not formed in the light guide 4.

The tip 4*a* of the light guide 4 is formed in a plane. Accordingly, the light guided by the light guide 4 is emitted outward as it is without changing an optical path thereof. Accordingly, as illustrated in FIG. 11, in the light distribution characteristics of the light emitted from the vehicle lighting device 1C, the light is emitted while being diffused from the vehicle lighting device 1C, that is from the tip 4*a* of the light guide 4 to the light emitting direction. However, in particular, intensity of the light in the light emitting direction is lower than intensity of the light around the light emitting direction.

The vehicle lighting device 1C can be applied not only to a case where the light is directly emitted to the lamp 100 for example, but also to a case where the light is emitted via a lamp side light guide plate (not illustrated) for example. When the light is indirectly emitted to the lamp 100, it is preferable that the light distribution characteristics of the vehicle lighting device 1C be similar to the light distribution characteristics of the light emitted from the optically connected lamp side light guide plate. Accordingly, without changing the light distribution characteristics of the light emitted from the light guide 4 having the same function as the lamp side light guide plate, the light is emitted to the lamp side light guide plate as it is. In this manner, if those which are different from the expected light distribution characteristics (light distribution characteristics of the vehicle lighting device 1C) are applied thereto as are in the light distribution characteristics of the vehicle lighting devices 1A and 1B, it is possible to prevent the light distribution characteristics of the light emitted from the lamp side light guide plate from being different from desired light distribution characteristics.

In addition, the light guide 4 of the first to third embodiments described above is formed in a cylindrical shape. The light guide 4 is formed so as to have a range of dimensions where the outer diameter is 5 mm to 20 mm, the height of a portion protruding from the cover 5 is 0 mm to 50 mm, and the height of a portion inserted into the opening 53 is 1 mm to 30 mm. In addition, when the recess 41 is formed in the light guide 4, the light guide 4 is formed in a circular truncated conical shape, a conical shape or a cylindrical shape. The light guide 4 is formed so as to have a range of dimensions where the diameter in the tip 4*a* is 2 mm to 19 mm (not exceeding the outer diameter of the light guide 4), the depth is 1 mm to 40 mm (not exceeding the height of the light guide 4), and the diameter in the bottom surface (end portion inside the light guide 4) is 0 mm to 19 mm (not exceeding the outer diameter of the light guide 4).

Fourth Embodiment

Figure 12:
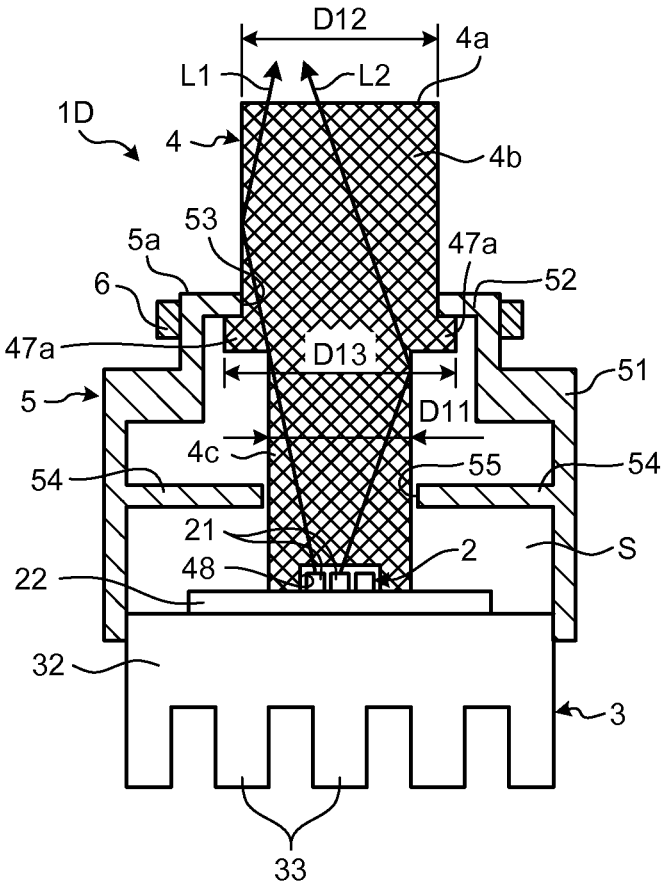
FIG. 12 is a partial cross-sectional view illustrating a vehicle lighting device according to a fourth embodiment.
Figure 13:
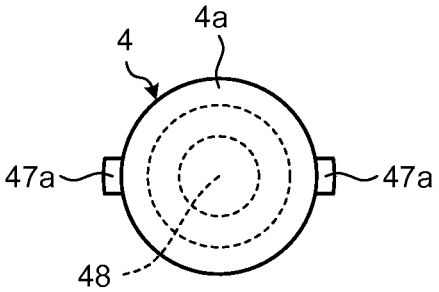
FIG. 13 is a plan view illustrating a light guide according to the fourth embodiment.
Figure 14:
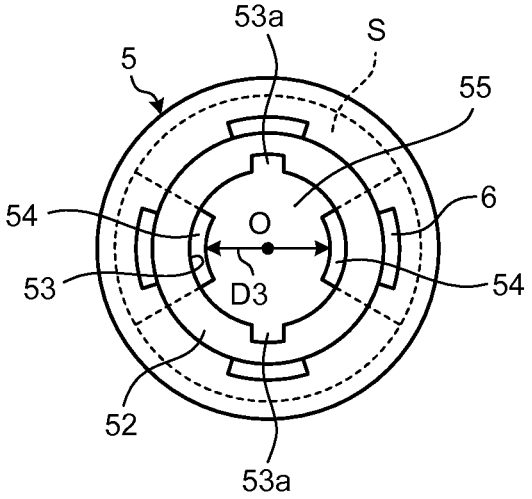
FIG. 14 is a plan view illustrating a cover according to the fourth embodiment.

A fourth embodiment will be described with reference to FIGS. 12 to 14. FIG. 12 is a partial cross-sectional view of a vehicle lighting device of the fourth embodiment. FIG. 13 is a plan view illustrating a light guide of the vehicle lighting device of the fourth embodiment. FIG. 14 is a plan view illustrating a cover of the vehicle lighting device of the fourth embodiment. FIG. 12 (FIGS. 15, 17 to 20 are also the same) mainly illustrates the light guide 4 and the cover 5 in a cross-sectional shape on a plane including the axial direction. In the fourth embodiment, a case will be described where each lighting element 21 of the light emitting unit 2 is not sealed with the resin and the holding unit 3 has no mount 31.

The light guide 4 is configured to include a light guide fixation portion 47*a* and a light emitting unit inserting recess 48.

The light guide fixation portion 47*a* is to be fixed to the cover 5, and is formed to protrude in the radial direction of the light guide 4 in a substantially center portion in the axial direction, that is, in the vertical direction of a vehicle lighting device 1D. In the present embodiment, as illustrated in FIG. 13, two light guide fixation portions 47*a* are formed with equal intervals in the circumferential direction. Here, within the light guide 4, the tip 4*a* side from the light guide fixation portion 47*a* is referred to as a tip side portion 4*b* and the light emitting unit 2 side is referred to as a light emitting unit side portion 4*c*. The tip side portion 4*b* and the light emitting unit side portion 4*c* have a cylindrical shape, and are formed so that an outer diameter D12 of the tip side portion 4*b* is larger than an outer diameter D11 of the light emitting unit side portion 4*c*. In addition, an outer diameter D13 of the light guide fixation portion 47*a* (twice the distance between the center axis of the light guide 4 and the outer peripheral surface which is farthest from the center axis within the light guide fixation portion 47*a*) is formed to be the largest outer diameter of the light guide 4. That is, the outer diameter D11 of the light emitting unit side portion 4*c*, the outer diameter D12 of the tip side portion 4*b* and the outer diameter D13 of the light guide fixation portion 47*a* have a relationship of D11<D12<D13. Accordingly, the outer diameter D12 from the light guide fixation portion 47*a* to the tip 4*a* side is larger than the outer diameter D11 from the light guide fixation portion 47*a* to the light emitting unit 2 side. In addition, the outer diameter D12 of the tip side portion 4*b* is set so that between the light beams (L1 and L2 illustrated in FIG. 12) guided from the light emitting unit 2 to the light guide 4, the light beam (L1) passing through a boundary between the light guide fixation portion 47*a* and the light emitting unit side portion 4*c* is not incident on a surface of the tip 4*a* side of the light guide fixation portion 47*a*.

The light emitting unit inserting recess 48 is formed on an end surface (lower surface) of the light emitting unit 2 side, and the light emitting unit 2 is inserted. Since the light emitting unit 2 is surrounded by the light emitting unit inserting recess 48, it is possible to prevent the light emitted from the light emitting unit 2 in the horizontal direction of the light emitting unit 2 from leaking out from the light guide 4. The light guide 4 is in contact with or is optically connected to the light emitting unit 2 with a slight gap. That is, the light emitted from the light emitting unit 2 is incident through the end surface of the light emitting unit 2 side of the light guide 4, is totally reflected inside the light guide 4 and is emitted outward from the tip 4*a*, that is, the end surface (upper surface) of the tip 4*a* side in the present embodiment.

A space S is formed between the cover 5 and the holding unit 3. The light emitting unit 2 is accommodated in the space S and is not exposed outward.

The opening 53 is formed in a center portion on an upper surface 5*a* of the cover 5, and the light guide 4 is inserted. In the present embodiment, the light guide 4 is inserted from the upper surface 5*a* side. A portion of the light guide 4, that is, the light emitting unit side portion 4*c* and the light guide fixation portion 47*a* are accommodated in the space S. Here, if the light guide fixation portion 47*a* is fixed to the cover 5 in a state where the light guide 4 is inserted into the opening 53*a*, the tip 4*a* is exposed from the opening 53. The opening 53 has a notched portion 53*a*. Two notched portions 53*a* are formed to protrude in the radial direction of the opening 53 with equal intervals in the circumferential direction so as to enable each light guide fixation portion 47*a* to be inserted as illustrated in FIG. 14 in the present embodiment. The diameter of the opening 53 is set so that when the light guide 4 is fixed to the cover 5, the outer peripheral surface of the light guide 4 and the cover 5 are in contact with each other in the horizontal direction, or oppose each other with a gap. When preventing leakage of the light guided by the light guide 4 from the boundary between the light guide 4 and the cover 5 to the cover 5 side, it is preferable to form a gap between the outer peripheral surface of the light guide 4 and the cover 5 in the opening 53, that is, it is preferable to cause the outer peripheral surface of the light guide 4 and the cover 5 to oppose each other so as not to be in contact with each other.

As illustrated in FIG. 12, the positioning portion 54 opposes the light guide 4 in the radial direction of the light guide 4, and is formed in the space S. In the present embodiment, the positioning portion 54 is arranged in a substantially center portion of the space S in the vertical direction of the vehicle lighting device 1D in FIG. 12. In addition, as illustrated in FIG. 14, the positioning portion 54 is formed to protrude toward a center O of the cover 5 in a substantially fan shape. Two positioning portions 54 are formed to oppose each other in the radial direction of the light guide 4. In a state where the light guide 4 is inserted into the opening 53, the positioning portion 54 opposes the light emitting unit 2 side from the light guide fixation portion 47*a* within the light guide 4, that is, the light emitting unit side portion 4*c*, in the radial direction of the light guide 4. A positioning space portion 55 formed between two positioning portions 54 is set so that a width D4 including the center O of the cover 5 is slightly larger than the outer diameter of the light guide 4, here, the outer diameter D11 of the light emitting unit side portion 4*c*. That is, it is prevented that the light guide 4 is fixed to the cover 5 in a state where each positioning portion 54 is in contact with the light guide 4. Accordingly, it is possible to prevent the light guided by the light guide 4 from leaking out from the boundary between the light guide 4 and the cover 5 to the cover 5 side by bringing the outer peripheral surface of the light guide 4 into contact with the cover 5.

Next, assembly of the vehicle lighting device 1D will be described. As illustrated in FIG. 12, the holding unit 3 is first caused to hold the light emitting unit 2 in advance. Then, in a state where the light guide fixation portion 47*a* and the notched portion 53*a* oppose each other in the vertical direction of the vehicle lighting device 1D in FIG. 12, the light guide 4 is inserted into the opening 53 of the cover 5. At this time, the light emitting unit side portion 4*c* passes through the positioning space portion 55. Then, if the light guide fixation portion 47*a* is positioned in the inner side (space S) of the cover 5 via the notched portion 53*a*, in a state where the light guide 4 is inserted into the opening 53, the light guide fixation portion 47*a* is fixed to the cover 5 by being rotated around the axis of the cover 5. In this manner, the light guide fixation portion 47*a* comes into contact with and is fixed to the cover 5 in the space S side of the upper surface 5*a* within the cover 5, that is, in the inner side of the cover 5. Then, the holding unit 3 is inserted into and fixed to the cover 5 to which the light guide 4 is fixed. At this time, the light emitting unit 2 is inserted into the light emitting unit inserting recess 48 of the positioned light guide 4 in the radial direction of the light guide 4 by using the positioning portion 54 and in the axial direction of the light guide 4 by using the light guide fixation portion 47*a*. Accordingly, when the light guide 4 is inserted into the cover 5, it is possible to perform positioning of the light guide 4 in the axial direction by using the positioning portion 54. In addition, it is possible to reliably perform the positioning of the light guide 4 in the axial direction by bringing the light guide fixation portion 47*a* protruding in the radial direction of the light guide 4 into contact with the space S side of the upper surface 5*a*. In this manner, the positioning of the light guide 4 in the axial direction and the radial direction is performed in advance. Therefore, it is possible to prevent the light guide 4 from coming into contact with the light emitting unit 2 even when the cover 5 is fixed to the holding unit 3. Furthermore, an attachment unit (not illustrated) allows the vehicle lighting device 1D to be attached to the lamp in a state of exposing the tip 4*a* of the light guide 4 into the lamp.

Next, an operation of the vehicle lighting device 1D will be described. The vehicle lighting device 1D is attached to a lamp as described above, and a power supply member is electrically connected to an external power source. If power supply from the external power source is started, the power supplied from the external power source to the substrate 22 via the power supply member is supplied to each light emitting element 21 and each light emitting element 21 emits the light using the supplied power, thereby allowing the light emitting unit 2 to emit the light. The light beams (L1 and L2 illustrated in FIG. 12) emitted from the light emitting unit 2 are incident on the light guide 4 from the light emitting unit inserting recess 48. The light guided into the light guide 4 is emitted into the lamp from the tip 4*a*, passes through a lens (not illustrated) from the inside of the lamp, and is emitted outward, that is, is emitted outward from a vehicle.

Here, when the light guide 4 is used, it is necessary to fix the light guide 4 to the cover 5 in which the light emitting element 21 is accommodated. For example, a method may be considered in which a flange-shaped fixation portion is formed in the light emitting element 21 side of the light guide 4 opposing the light emitting element 21, the fixation portion is inserted into a reception portion formed inside the cover 5, and an opposite side to the light emitting element 21 side is brought into close contact with and is fixed to the cover 5 from the fixation portion within the light guide 4. In this case, there is a possibility that the light emitted from the light emitting element 21 and guided by the light guide 4 may leak out to the cover 5 side in the boundary between the light guide 4 and the cover 5, thereby causing a problem in that a light-extraction efficiency of the light emitted from the light guide 4 is degraded.

As described above, in a state where the light guide 4 is inserted to the opening 53 of the cover 5, the vehicle lighting device 1D according to the present embodiment is fixed to the cover 5 by using the light guide fixation portion 47*a*. Thus, it is possible to reduce a contact area between the light guide 4 and the cover 5. Accordingly, the light guide 4 can mostly come into contact with the space S, that is, an air layer. Therefore, by bringing the outer peripheral surface of the light guide 4 into contact with the cover 5, it is possible to prevent the light guided by the light guide 4 from leaking out from the boundary between the light guide 4 and the cover 5 to the cover 5 side.

In addition, the light guide 4 is fixed to the cover 5 by using the light guide fixation portion 47*a*, and the outer diameter D12 of the tip side portion 4*b* is larger than the outer diameter D11 of the light emitting unit side portion 4*c*. Thus, it is possible to prevent an increase in the frequency of refraction until the light emitted from the light emitting unit 2 and guided by the light guide 4 is reflected on a surface of the tip 4*a* side of the light guide fixation portion 47*a* and is guided to the tip 4*a*. Accordingly, it is possible to prevent the optical path from being lengthened, and it is possible to decrease the light emitted outward from the light guide fixation portion 47*a*. In this manner, by fixing the light guide 4 to the cover 5, it is possible to prevent the light-extraction efficiency of the light emitted from the light guide 4 from being degraded.

Figure 15:
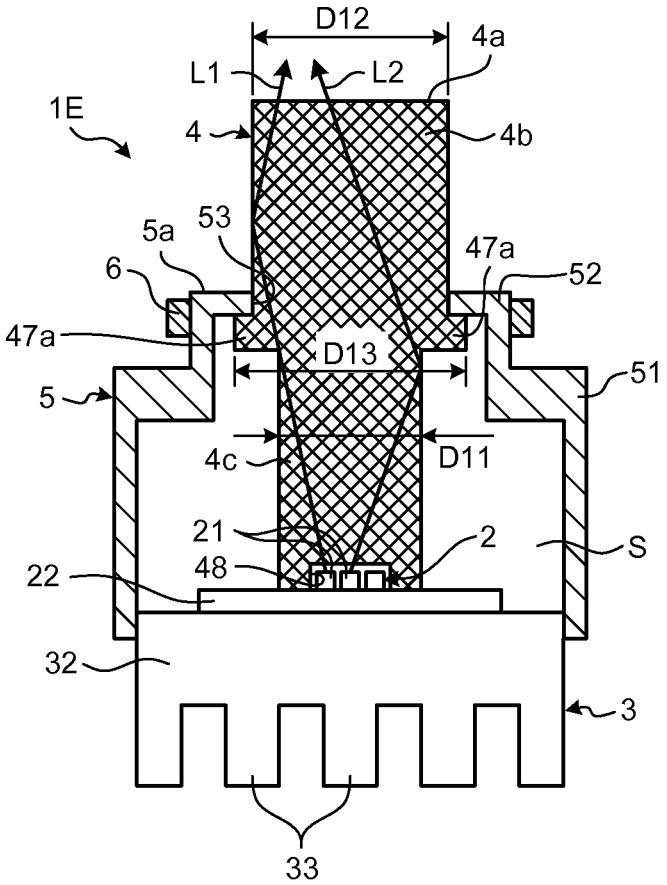
FIG. 15 is a partial cross-sectional view illustrating a modification example according to the fourth embodiment.
Figure 16:
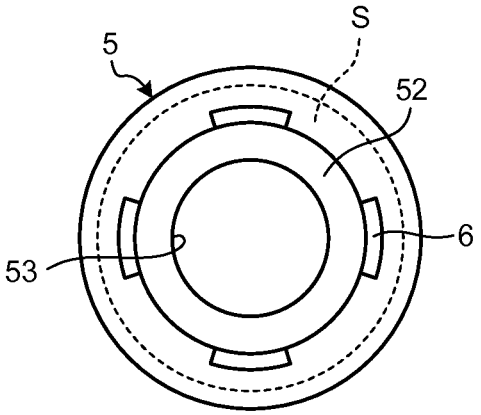
FIG. 16 is a plan view illustrating a cover in a modification example according to the fourth embodiment.

In the fourth embodiment described above, the positioning portion 54 is disposed in the cover 5, but the embodiments described herein are not limited thereto. FIG. 15 is a partial cross-sectional view illustrating a modification example of the vehicle lighting device of the fourth embodiment. FIG. 16 is a plan view illustrating a cover in the modification example of the vehicle lighting device of the fourth embodiment. As illustrated in FIG. 15, the cover 5 of a vehicle lighting device 1E may not include the positioning portion 54 illustrated in FIG. 12. In this case, in a state where the light guide fixation portion 47*a* and opening 53 oppose each other in the vertical direction of the vehicle lighting device 1E in FIG. 15, the light guide 4 can be inserted into the opening 53 from the space S side. Accordingly, as illustrated in FIG. 16, the cover 5 may not include the notched portion 53*a* illustrated in FIG. 14.

Figure 17:
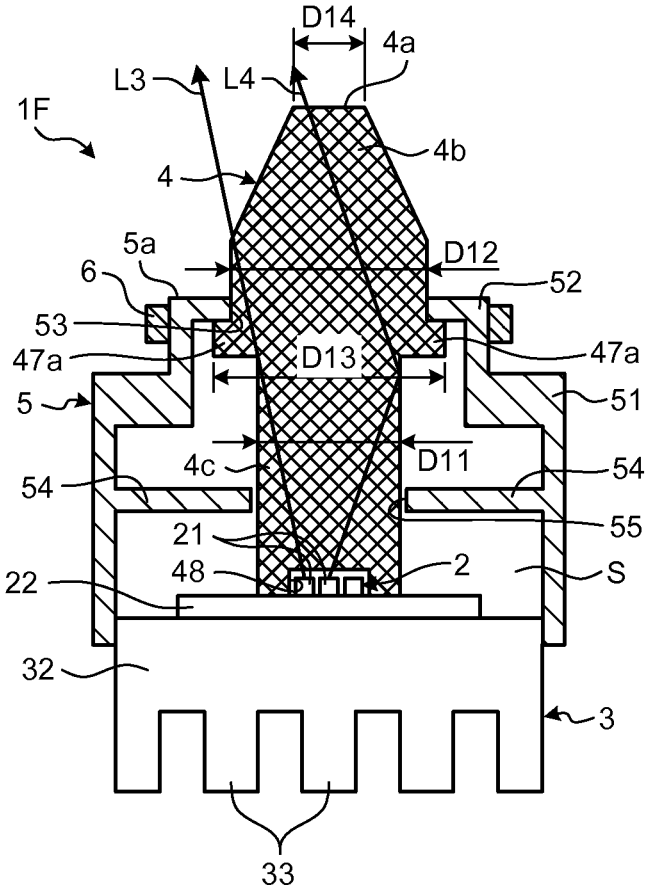
FIG. 17 is a partial cross-sectional view illustrating a first modification example according to the fourth embodiment.
Figure 18:
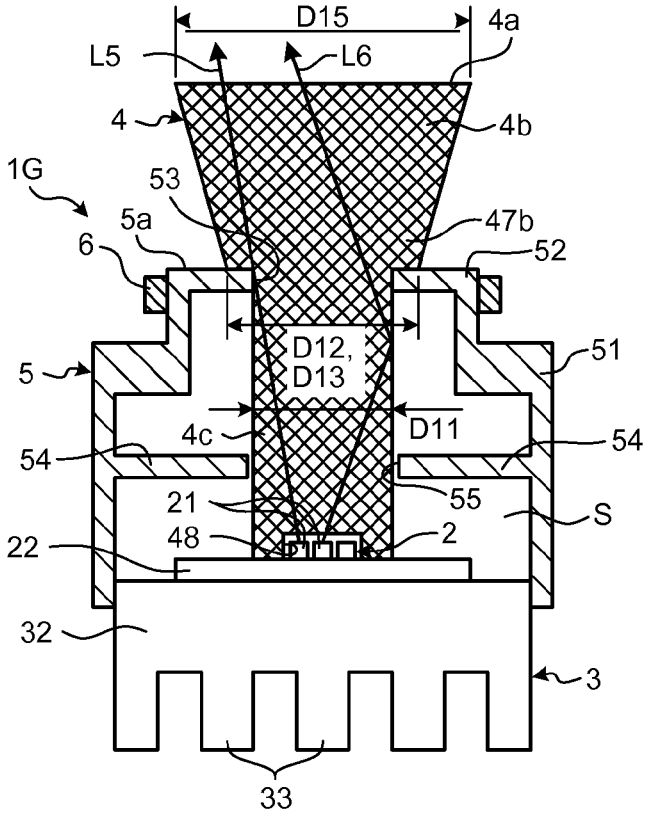
FIG. 18 is a partial cross-sectional view illustrating a second modification example according to the fourth embodiment.
Figure 19:
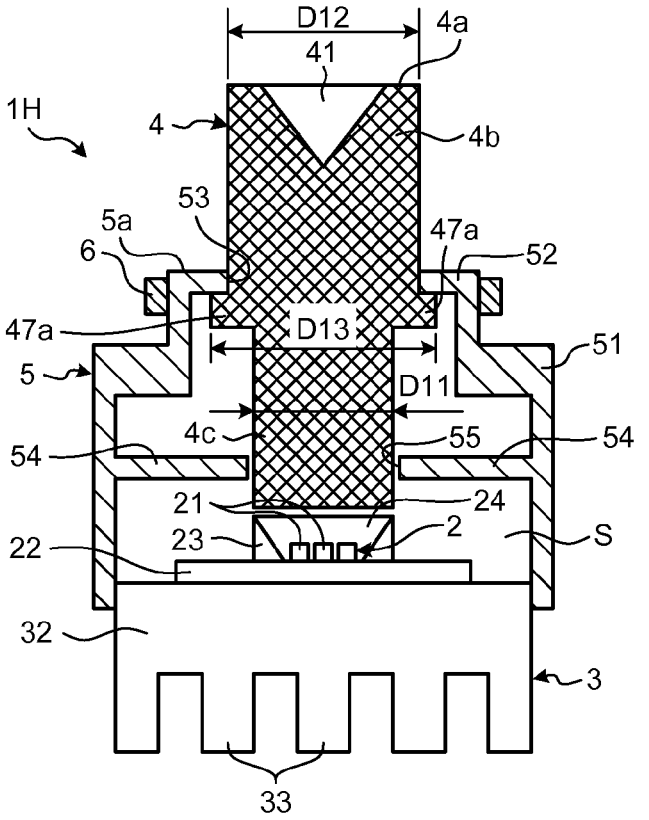
FIG. 19 is a partial cross-sectional view illustrating a third modification example according to the fourth embodiment.

In the fourth embodiment described above, the shape of the light guide 4 is the cylindrical shape, but the embodiment is not limited thereto. FIG. 17 is a partial cross-sectional view illustrating a first modification example of the vehicle lighting device of the fourth embodiment. FIG. 18 is a partial cross-sectional view illustrating a second modification example of the vehicle lighting device of the fourth embodiment. FIG. 19 is a partial cross-sectional view illustrating a third modification example of the vehicle lighting device of the fourth embodiment. The outer diameter D12 of the tip side portion 4*b* may not be constant from an end portion of the light emitting unit 2 side to the tip 4*a*. As illustrated in FIG. 17, a vehicle lighting device 1F may be configured so that a portion from the light emitting unit 2 side of the tip side portion 4*b* to a portion exposed from the cover 5 is set to be a constant outer diameter D12, an outer diameter of the tip 4*a* side is more decreased than the outer diameter D12, and the tip 4*a* is allowed to have an outer diameter D14 which is smaller than the outer diameter D12. In addition, as illustrated in FIG. 18, a vehicle lighting device 1G may be configured so that an outer diameter from an end portion of the light emitting unit 2 side of the tip side portion 4*b* to the tip 4*a* is increased and the tip 4*a* is allowed to have an outer diameter D16 which is larger than the outer diameter D12 of the end portion of the light emitting unit 2 side. That is, the outer diameter D12 of the end portion of the light emitting unit 2 side of the tip side portion 4*b* is larger than the outer diameter D11 of the light emitting unit side portion 4*c*, the light distribution characteristics may be changed by changing the shape of the tip 4*a* and changing the optical path of the guided light beams (L3 and L4 illustrated in FIG. 17, L5 and L6 illustrated in FIG. 18). As illustrated in FIG. 18, the light guide fixation portion 47*b* may be formed so as to surround the tip side portion 4*b* (the outer diameter D13 of the end portion of the light emitting unit 2 side of the fixation unit 43 is the same as the outer diameter D12 of the end portion of the light emitting unit 2 side of the tip side portion 4*b*). That is, the tip side portion 4*b* may be caused to function as the light guide fixation portion 47*b*. In this case, similar to a fifth embodiment (to be described later), the light guide fixation portion 47*b* is fixed to an outer side of the cover 5.

In addition, as illustrated in FIG. 19, a vehicle lighting device 1H may be configured so that the recess 41 is formed in the tip 4*a* as in the vehicle lighting device 1A of the first embodiment described above. The recess 41 may be formed in a conical shape, an elliptical cone shape, a bottomed cylinder shape (for example, horizontal bottom surface), a circular truncated conical shape (trapezoidal shape to be flared toward the tip 4*a* in a cross-sectional shape on a plane including the axis of the light guide 4). The recess 41 may be configured so that the outer peripheral line in a cross-sectional shape may be either a straight line or a curve. In addition, the recessed surface of the recess 41 may be formed to have a rough surface. For example, the recessed surface is formed to have the rough surface so that surface roughness Ra of the recessed surface is equal to or greater than 0.2. Accordingly, the light incident on the recessed surface is scattered and emitted outward from the recessed surface since the recessed surface is the rough surface. Therefore, it is possible to change the light distribution characteristics determined when the recessed surface is not formed to have the rough surface so as to be different light distribution characteristics. For example, it is possible to change the light distribution characteristics so as to have an incandescent bulb shape. The reflection material or the scattering material may be brought into close contact with the recessed surface of the recess 41. For example, the reflection material is a material in which the same material as the material forming the light guide 4 is used as a base material and reflection materials (white particles) are included. By reflecting the light incident on the reflection material from the light guide 4 into the light guide 4, it is possible to prevent the light from being emitted outward from the light guide 4 from the reflection material. For example, the scattering material is a material in which the same material as the material forming the light guide 4 is used as a base material and scattering materials (scattering powder) are included. The light incident on the scattering material via the recessed surface is scattered and emitted outward from the recess 41. Accordingly, it is possible to change the light distribution characteristics determined when the recessed surface 41*a* is not formed to have the rough surface so as to be different light distribution characteristics. That is, by changing the shape of the tip 4*a*, it is possible to change the light distribution characteristics of the vehicle lighting device 1H to be desired light distribution characteristics.

Fifth Embodiment

Figure 20:
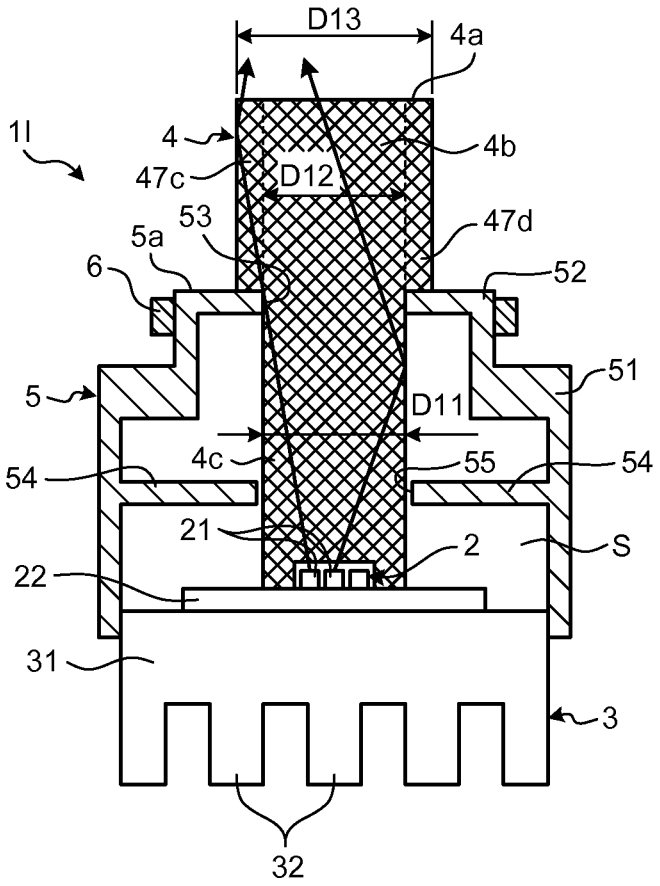
FIG. 20 is a partial cross-sectional view illustrating a vehicle lighting device according to a fifth embodiment.
Figure 21:
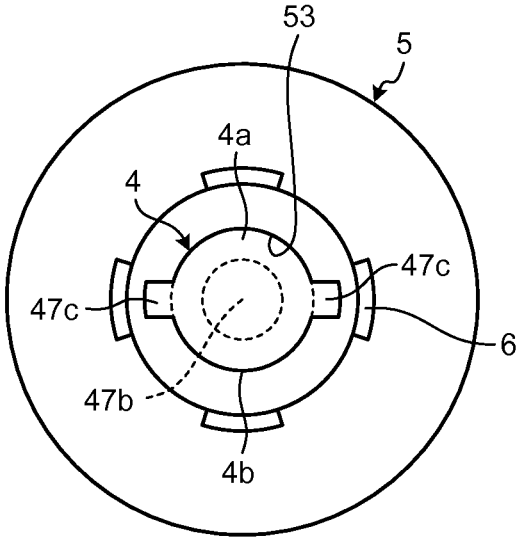
FIG. 21 is a plan view illustrating a vehicle lighting device according to a sixth embodiment.

Next, a fifth embodiment will be described. FIG. 20 is a partial cross-sectional view illustrating a vehicle lighting device of the fifth embodiment. FIG. 21 is a plan view illustrating the vehicle lighting device of the fifth embodiment. A vehicle lighting device 1I illustrated in FIG. 20 is different from the vehicle lighting device 1D in that a light guide fixation portion 47*c* is fixed to the outer side of the cover 5.

The light guide 4 has the tip side portion 4*b* of the tip 4*a* side from the light guide fixation portion 47*c* and the light emitting unit side portion 4*c* of the light emitting unit side from the light guide fixation portion 47*c*, two portions of which have a different outer diameter. The tip side portion 4*b* is positioned in an outer portion side which is the opposite side to the space S side of the upper surface 5*a* of the cover 5. The light emitting unit side portion 4*c* is positioned in the space S of the upper surface 5*a*. The tip side portion 4*b* and the light emitting unit side portion 4*c* have a cylindrical shape. The outer diameter D12 of a portion excluding the light guide fixation portion 47*c* of the tip side portion 4*b* is the same as the outer diameter D11 of the light emitting unit side portion 4*c*. The light guide fixation portion 47*c* is formed in the tip side portion 4*b*. In the present embodiment, the light guide fixation portion 47*c* is formed to protrude in the radial direction of the light guide 4 in the tip side portion 4*b*. As illustrated in FIG. 21, two light guide fixation portions 47*c* are formed in the circumferential direction with equal intervals. In addition, the outer diameter D13 of the light guide fixation portion 47*d* (twice the distance between the center axis of the light guide 4 and the outer peripheral surface which is farthest from the center axis within the light guide fixation portion 47*a*) is formed to be the largest outer diameter of the light guide 4. That is, the outer diameters D11 to D13 have a relationship of D11 (=D12)<D13. The outer diameter D12 of the tip 4*a* side from the light guide fixation portion 47*c* is the same as the outer diameter D11 of the light emitting unit 2 side from the light guide fixation portion 47*c*. The outer diameter D13 of the light guide fixation portion 47*c* is larger than the outer diameter D12 of the tip 4*a* side from the light guide fixation portion 47*c*. Here, in the present embodiment, the light guide fixation portion 47*c* is formed to extend to the tip 4*a*. However, the height from the upper surface 5*a* of the cover 5 may be lower than the height of the tip side portion 4*b*.

When assembling the vehicle lighting device 1I, if the light guide 4 is inserted into the opening 53 of the cover 5, the light emitting unit side portion 4*c* is caused to pass through the positioning space portion 54 and the light guide fixation portion 47*c* is brought into contact with the upper surface 5*a* of the cover 5. In this state, the light guide fixation portion 47*c* is fixed to the cover 5. In this manner, the light guide fixation portion 47*c* is brought into contact with and fixed to the outer portion side of the upper surface 5*a* within the cover 5, that is, the outer side of the cover 5. It is possible to reliably perform the positioning of the light guide 4 in the axial direction by bringing the light guide fixation portion 47*c* protruding in the radial direction of the light guide 4 into contact with outer portion side of the upper surface 5*a*.

As described above, the vehicle lighting device 1I according to the present embodiment demonstrates an effect which is the same as that of the fourth embodiment described above. It is possible to perform the positioning of the light guide 4 with respect to the cover 5 simply by inserting the light guide 4 into the opening 53 of the cover 5. Accordingly, it is possible to improve efficiency of the assembly work. Here, the fifth embodiment can employ the modification examples illustrated in FIGS. 17 to 19.

In the fourth and fifth embodiments and the first to third modification examples of the fourth embodiment, when the light guide fixation portions 47*a* to 47*c* are brought into contact with the upper surface 5*a* of the cover 5, a recess into which the light guide fixation portions 47*a* to 47*c* are inserted may be formed on the upper surface 5*a* in advance. In the fourth and fifth embodiments and the first to third modification examples of the fourth embodiment, without forming the light emitting unit inserting recess 48 in the light guide 4, similar to the first to third embodiments, the end portion of the light emitting unit 2 side of the light guide 4 may be arranged to oppose the light emitting unit 2.

The fixing method of the light guide 4 with respect to the cover 5 in the above-described embodiments (including all embodiments and all modification examples) is not particularly limited. Any fixing method such as mechanical fixing by using engagement members and fastening members or chemical fixing by using an adhesive may be used.

In addition, in the above-described embodiments, the cover 5 to which the light guide 4 is fixed may be attachable to and detachable from the holding unit 3. In this case, the light guide 4 and the cover 5 are unitized together in advance by fixing the light guide 4 which is different in a type corresponding to each embodiment (modification example) to the cover 5 in advance. In contrast, the light emitting unit 2 is held by the holding unit 3 to be unitized together in advance. Then, a unit of the light guide 4 and the cover 5 which satisfies the light distribution characteristics is selected for the vehicle lighting device required according to the lamp to be attached, and the selected unit is mounted on the unit of the light emitting unit 2 and the holding unit 3. In this manner, the unit of the light guide 4 and the cover 5 is selected and replaced with respect to the unit of the light emitting unit 2 and the holding unit 3. Therefore, it is possible to provide a vehicle lighting device having desired light distribution characteristics.

In addition, in the above-described embodiments, the substrate 22 functions as the mounting substrate and the driving substrate, but may be used separate from the mounting substrate and the driving substrate. In this case, the driving substrate does not need to focus on heat transfer, since components generating a lot of heat such as each light emitting element 21 are not mounted thereon. Therefore, it is possible to provide an insulating substrate formed of inexpensive materials such as paper phenol, paper epoxy, glass epoxy and the like.

As described above, according to the above-described embodiments, it is possible to decrease the proportion occupied by the light non-emitting region with respect to the light emitting region when viewed from the front.

In addition, according to the above-described embodiments, by fixing the light guide 4 to the cover 5, it is possible to prevent the light-extraction efficiency of the light emitted from the light guide 4 from being degraded.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A vehicle lighting device comprising:

a light emitting unit configured to have one or more light emitting elements;

a holding unit configured to hold the light emitting unit;

a light guide configured to guide light emitted from the light emitting unit and emit the light from a tip which is on a tip side opposite to a light emitting unit side;

a cover configured to include a first fixation unit which has a cylindrical shape and is fixed to the holding unit from an outer circumference of the holding unit, and a second fixation unit which has a cylindrical shape and a diameter smaller than a diameter of the first fixation unit and holds the light guide inside in a state of exposing the tip, the first fixation unit and the second fixation unit being fixed to each other; and a plurality of attachment units configured to protrude from an outer surface of the second fixation unit and to be formed in a shape attachable to a reflector, wherein the light guide has a cylindrical shape, wherein the cover has an opening to which the light guide is inserted in a state of exposing the tip, and which accommodates a portion of the light guide and the light emitting unit in a space formed between the holding unit and the cover, and wherein the light guide has a light guide fixation portion to be fixed to the cover in a state of being inserted into the opening, and has an outer diameter from the light guide fixation portion to the tip side, which is larger than an outer diameter from the light guide fixation portion to the light emitting unit side;

wherein a ratio D1/D2 of an outer diameter D1 of the light guide to an outer diameter D2 of the second fixation unit has a relationship: $0.1 \leq D1/D2 \leq 0.9$.

2. The device according to claim 1, wherein the tip of the light guide has a recess.

3. The device according to claim 2, wherein the recess has a recessed surface with which a reflection material or a scattering material is in close contact.

4. The device according to claim 1, wherein the cover is attachable to and detachable from the holding unit.

5. The device according to claim 1, wherein the cover has a positioning portion which opposes the light guide in a radial direction of the light guide, and wherein at least one of the positioning portions is formed in the space in a circumferential direction.

6. The device according to claim 1, wherein the light guide fixation portion protrudes in a radial direction of the light guide, and at least one of the light guide fixation portions is formed in a circumferential direction.

7. The device according to claim 1, wherein an outer diameter of the light guide fixation portion is larger than the outer diameter from the light guide fixation portion to the tip side, and wherein the light guide fixation portion is internally fixed to the cover inside the cover.

8. The device according to claim 1, wherein the light guide fixation portion is externally fixed to the cover outside the cover.

9. The device according to claim 1, wherein the cover has an opening to which the light guide is inserted in a state of exposing the tip, and which accommodates a portion of the light guide and the light emitting unit in a space formed between the holding unit and the cover, wherein the light guide has a light guide fixation portion to be externally fixed to the cover outside the cover in a state of being inserted into the opening, wherein an outer diameter from the light guide fixation portion to the tip side is the same as an outer diameter from the light guide fixation portion to the light emitting unit side, and wherein the outer diameter of the light guide fixation portion is larger than the outer diameter from the light guide fixation portion to the tip side.

* * * * *